US010228174B2

(12) United States Patent
Liu et al.

(10) Patent No.: US 10,228,174 B2
(45) Date of Patent: Mar. 12, 2019

(54) COMPRESSOR OVER-LOAD PROTECTION CONTROL METHOD AND APPARATUS

(71) Applicant: Gree Electric Appliances, Inc. of ZHUHAI, Zhuhai, Guangdong (CN)

(72) Inventors: Wei Liu, Guangdong (CN); Yongchao Liang, Guangdong (CN); Peili Li, Guangdong (CN); Ding Yu, Guangdong (CN); Yuping Gao, Guangdong (CN); Pengyu Chen, Guangdong (CN); Yonghong Luo, Guangdong (CN); Zuqing Chen, Guangdong (CN); Qiyang Peng, Guangdong (CN); Chun Wang, Guangdong (CN); Jianqun Yang, Guangdong (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 173 days.

(21) Appl. No.: 15/031,845

(22) PCT Filed: Oct. 20, 2014

(86) PCT No.: PCT/CN2014/088976
§ 371 (c)(1),
(2) Date: Apr. 25, 2016

(87) PCT Pub. No.: WO2015/058666
PCT Pub. Date: Apr. 30, 2015

(65) Prior Publication Data

US 2016/0265828 A1 Sep. 15, 2016

(30) Foreign Application Priority Data

Oct. 24, 2013 (CN) ..... 2013 1 0508782

(51) Int. Cl.
*F04B 49/02* (2006.01)
*F25B 49/02* (2006.01)
(Continued)

(52) U.S. Cl.
CPC ..... *F25B 49/022* (2013.01); *F04B 49/02* (2013.01); *F04B 49/065* (2013.01); *F25B 31/02* (2013.01);
(Continued)

(58) Field of Classification Search
CPC ..... F04B 49/065; F04B 49/02; F25B 49/022; F25B 31/02; F25B 2700/2117; F25B 2600/02; F25B 2500/19
See application file for complete search history.

(56) References Cited

U.S. PATENT DOCUMENTS 5,802,862 A 9/1998 Eiermann

FOREIGN PATENT DOCUMENTS

CN 1389888 A 1/2003
CN 1445455 A 10/2003
(Continued)

*Primary Examiner* — Ana M Vazquez
(74) *Attorney, Agent, or Firm* — Novick, Kim & Lee, PLLC; Sang Ho Lee; Zhi Yang Xue

(57) ABSTRACT

Provided is a compressor over-load protection control method. The method includes that: the state of a compressor is detected (S101); it is judged whether the compressor is under over-load protection (S102); and when the compressor is under the over-load protection, fluorine shortage protection is shielded (S103). A compressor over-load protection control apparatus includes: a detection unit (10), configured to detect the state of a compressor; a judgement unit (20), configured to judge whether the compressor is under over-load protection; and a shielding unit (30), configured to shield fluorine shortage protection when the compressor is under the over-load protection. Through the method and
(Continued)

apparatus, the problem in the relevant art that a fluorine shortage false alarm is easily triggered is solved, thereby achieving the effect of preventing the fluorine shortage false alarm when the compressor is under the over-load protection.

12 Claims, 4 Drawing Sheets

(51) Int. Cl.
*F25B 31/02* (2006.01)
*F04B 49/06* (2006.01)

(52) U.S. Cl.
CPC ..... *F25B 2500/06* (2013.01); *F25B 2500/19* (2013.01); *F25B 2600/02* (2013.01); *F25B 2700/2117* (2013.01)

(56) References Cited

FOREIGN PATENT DOCUMENTS

| | | | |
|---|---|---|---|
| CN | 101124436 | A | 2/2008 |
| CN | 101256045 | A | 9/2008 |
| CN | 101782262 | A | 7/2010 |
| CN | 101893310 | A | 11/2010 |
| CN | 101929719 | B | 7/2012 |
| CN | 103306962 | A | 9/2013 |
| EP | 1538337 | A1 | 6/2005 |
| JP | H09310942 | A | 12/1997 |
| JP | 2008209021 | A | 9/2008 |

COMPRESSOR OVER-LOAD PROTECTION CONTROL METHOD AND APPARATUS

TECHNICAL FIELD OF THE DISCLOSURE

The disclosure relates to the field of control, and in particular to a compressor over-load protection control method and apparatus.

BACKGROUND OF THE DISCLOSURE

In order to ensure safe running of a dehumidifier and an air conditioner, in the relevant art, the dehumidifier and the air conditioner will have a coolant leakage protection function and an over-load protection function generally. The over-load protection function is mainly realized by means of an over-load protector.

For example, when the over-load protector detects that exhaust temperatures of the dehumidifier and the air conditioner exceed exhaust temperature threshold values, power switches of compressors of the dehumidifier and the air conditioner will be turned off, so that the over-load protection of the dehumidifier and the air conditioner is realized. At this time, although the power switches of compressors of the dehumidifier and the air conditioner have been turned off, the overall compressors are still electrified. Thus, when a data parameter detected by a main controller satisfies judgement logic for coolant leakage protection, the dehumidifier and the air conditioner will give a fluorine shortage alarm and execute a fluorine shortage protection motion. Under the circumstances, the dehumidifier and the air conditioner actually mistake the over-load protection for fluorine shortage protection, thereby triggering a fluorine shortage false alarm.

An effective solution has not been proposed currently for the problem in the relevant art that the fluorine shortage false alarm is easily triggered.

SUMMARY OF THE DISCLOSURE

The disclosure mainly aims to provide a compressor over-load protection control method and apparatus, which are intended to solve the problem in the relevant art that the fluorine shortage false alarm is easily triggered.

In order to achieve the aim, according to one aspect of the disclosure, a compressor over-load protection control method is provided, which may include that: the state of a compressor is detected; it is judged whether the compressor is under over-load protection; and if the compressor is under the over-load protection, fluorine shortage protection is shielded.

Furthermore, the compressor over-load protection control method may be configured for over-load protection of a dehumidifier. The dehumidifier may include an evaporator and the compressor. The step that the state of the compressor is detected may include that: a tube temperature of the evaporator within a first target time period and an environment temperature and a tube temperature of the evaporator within a second target time period are detected, the first target time period and the second target time period being adjacent time periods, and the second target time period being behind the first target time period. The step that it is judged whether the compressor is under the over-load protection may include that: it is judged whether the tube temperature within the first target time period continuously rises and reaches a maximum value; after it is judged that the tube temperature within the first target time period continuously rises and reaches the maximum value, it is judged whether a temperature difference obtained by continuous rise of the tube temperature within the first target time period is greater than or equal to a pre-set temperature difference; after it is judged that the temperature difference obtained by continuous rise of the tube temperature within the first target time period is greater than or equal to the pre-set temperature difference, it is judged whether a difference between the environment temperature and the tube temperature within the second target time period is smaller than a pre-set temperature difference limiting value; and if it is judged that the difference between the environment temperature and the tube temperature within the second target time period is smaller than the pre-set temperature difference limiting value, it is determined that the compressor is under the over-load protection.

Furthermore, the step that the tube temperature of the evaporator within the first target time period is detected may include that: a first tube temperature of the evaporator at a first moment is detected, a second tube temperature of the evaporator at a second moment is detected, and a third tube temperature of the evaporator at a third moment is detected, the first moment, the second moment and the third moment being any successive time points within the first target time period, the second moment being behind the first moment, and the third moment being behind the second moment. The step that it is judged whether the tube temperature within the first target time period continuously rises and reaches the maximum value may include that: it is judged whether the tube temperature of the evaporator within the first target time period continuously rises and reaches the maximum value by judging a size relationship among the first tube temperature, the second tube temperature and the third tube temperature.

Furthermore, the step that the tube temperature of the evaporator within the second target time period is detected may include that: a fourth tube temperature of the evaporator at a fourth moment is detected, and a fifth tube temperature of the evaporator at a fifth moment is detected, the fourth moment and the fifth moment being any successive time points within the second target time period, and the fifth moment being behind the fourth moment. The step that it is judged whether the difference between the environment temperature and the tube temperature within the second target time period is smaller than the pre-set temperature difference limiting value may include that: a temperature difference between the fifth tube temperature and the fourth tube temperature is calculated; and it is judged whether the tube temperature continuously drops within the second target time period by judging whether the temperature difference is less than 0.

Furthermore, the step that the fluorine shortage protection is shielded may include that: a pre-set over-load protection time period is obtained; the first target time period and the second target time period are removed from the pre-set over-load protection time period to determine a third target time period, the third target time period being adjacent to the second target time period, and the third target time period being behind the second target time period; and the fluorine shortage protection is shielded within the third target time period.

Furthermore, before the fluorine shortage protection is shielded within the third target time period, the step that the fluorine shortage protection is shielded may further include that: a fluorine shortage protection stop command sent to the compressor is obtained, the fluorine shortage protection stop command including a first fluorine shortage protection stop command, a second fluorine shortage protection stop command and a third fluorine shortage protection stop command; and it is detected whether a moment at which the third fluorine shortage protection stop command is sent is within the first target time period or the second target time period, wherein if it is detected that the moment at which the third fluorine shortage protection stop command is sent is not within the first target time period or the second target time period, the fluorine shortage protection is shielded.

In order to achieve the aim, according to another aspect of the disclosure, a compressor over-load protection control apparatus is provided, which may include: a detection unit, configured to detect the state of a compressor; a judgement unit, configured to judge whether the compressor is under over-load protection; and a shielding unit, configured to shield fluorine shortage protection if the compressor is under over-load protection.

Furthermore, the compressor over-load protection control apparatus may be configured for over-load protection of a dehumidifier. The dehumidifier may include an evaporator and the compressor. The detection unit may be further configured to detect a tube temperature of the evaporator within a first target time period and an environment temperature and a tube temperature of the evaporator within a second target time period, the first target time period and the second target time period being adjacent time periods, and the second target time period being behind the first target time period. The judgement unit may include: a first judgement module, configured to judge whether the tube temperature within the first target time period continuously rises and reaches a maximum value; a second judgement module, configured to judge whether a temperature difference obtained by continuous rise of the tube temperature within the first target time period is greater than or equal to a pre-set temperature difference after it is judged that the tube temperature within the first target time period continuously rises and reaches the maximum value; a third judgement module, configured to judge whether a difference between the environment temperature and the tube temperature within the second target time period is smaller than a pre-set temperature difference limiting value after it is judged that the temperature difference obtained by continuous rise of the tube temperature within the first target time period is greater than or equal to the pre-set temperature difference; and a first determination module, configured to determine that the compressor is under the over-load protection if it is judged that the difference between the environment temperature and the tube temperature within the second target time period is smaller than the pre-set temperature difference limiting value.

Furthermore, the detection unit may include: a first detection module, configured to detect a first tube temperature of the evaporator at a first moment; a second detection module, configured to detect a second tube temperature of the evaporator at a second moment; and a third detection module, configured to detect a third tube temperature of the evaporator at a third moment, the first moment, the second moment and the third moment being any successive time points within the first target time period, the second moment being behind the first moment, and the third moment being behind the second moment. The first judgement module may be further configured to judge whether the tube temperature of the evaporator within the first target time period continuously rises and reaches the maximum value by judging a size relationship among the first tube temperature, the second tube temperature and the third tube temperature.

Furthermore, the detection unit may further include: a fourth detection module, configured to detect a fourth tube temperature of the evaporator at a fourth moment; and a fifth detection module, configured to detect a fifth tube temperature of the evaporator at a fifth moment, the fourth moment and the fifth moment being any successive time points within the second target time period, and the fifth moment being behind the fourth moment. The second judgement module may include: a calculation sub-module, configured to calculate a temperature difference between the fifth tube temperature and the fourth tube temperature; and a judgement sub-module, configured to judge whether the tube temperature continuously drops within the second target time period by judging whether the temperature difference is less than 0.

Furthermore, the shielding unit may include: a first obtaining module, configured to obtain a pre-set over-load protection time period; a second determination module, configured to remove the first target time period and the second target time period from the pre-set over-load protection time period to determine a third target time period, the third target time period being adjacent to the second target time period, and the third target time period being behind the second target time period; and a shielding module, configured to shield the fluorine shortage protection within the third target time period.

Furthermore, the shielding unit may further include: a second obtaining module, configured to obtain a fluorine shortage protection stop command sent to the compressor before the fluorine shortage protection is shielded within the third target time period, the fluorine shortage protection stop command including a first fluorine shortage protection stop command, a second fluorine shortage protection stop command and a third fluorine shortage protection stop command; and a sixth detection module, configured to detect whether a moment at which the third fluorine shortage protection stop command is sent is within the first target time period or the second target time period, wherein the shielding unit may be further configured to shield the fluorine shortage protection when it is detected that the moment at which the third fluorine shortage protection stop command is sent is not within the first target time period or the second target time period.

By means of the disclosure, the state of the compressor is detected; it is judged whether the compressor is under the over-load protection; and if the compressor is under the over-load protection, the fluorine shortage protection is shielded. The problem in the relevant art that the fluorine shortage false alarm is easily triggered is solved, thereby achieving the effect of preventing the fluorine shortage false alarm when the compressor is under the over-load protection.

BRIEF DESCRIPTION OF THE DRAWINGS

The drawings described here are intended to provide further understanding of the disclosure, and form a part of the disclosure. The schematic embodiments and descriptions of the disclosure are intended to explain the disclosure, and do not form improper limits to the disclosure. In the drawings.

DETAILED DESCRIPTION OF THE EMBODIMENTS

It is important to note that the embodiments of the disclosure and the characteristics in the embodiments can be combined under the condition of no conflicts. The disclosure is described below with reference to the drawings and the embodiments in detail.

It is important to note that a compressor over-load protection control method and apparatus in the disclosure can be configured for over-load protection of a dehumidifier and an air conditioner, wherein the dehumidifier and the air conditioner each include a compressor and an evaporator.

According to the embodiments of the disclosure, a compressor over-load protection control apparatus is provided, which is configured to shield fluorine shortage protection when a compressor is under over-load protection.

Figure 1:
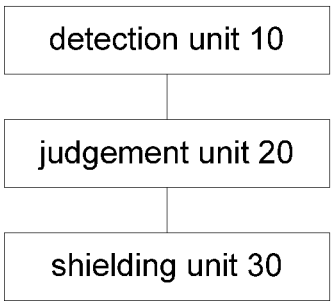
FIG. 1 is a diagram of a compressor over-load protection control apparatus according to a first embodiment of the disclosure.

FIG. 1 is a diagram of a compressor over-load protection control apparatus according to a first embodiment of the disclosure. As shown in FIG. 1, the apparatus includes: a detection unit 10, a judgement unit 20 and a shielding unit 30.

The detection unit 10 is configured to detect the state of a compressor. The state of the compressor may be a power-on state and a power-off state. It is important to note that in the embodiment of the disclosure, when the compressor is in the power-off state, the overall compressor is still in an electrified state. When the compressor is over-loaded, an exhaust temperature of the compressor will be very high. Once the exhaust temperature of the compressor is over-high, the compressor will be powered off. At this time, the detection unit 10 will detect that the state of the compressor is the power-off state. Otherwise, the detection unit 10 will detect that the state of the compressor is the power-on state. The detection unit 10 can detect whether the compressor is in the power-on state or the power-off state by detecting a tube temperature of an evaporator. It is important to note that the detection unit 10 is a part of a main controller for the dehumidifier and the air conditioner.

The judgement unit 20 is configured to judge whether the compressor is under over-load protection. When the detection unit 10 detects that the state of the compressor is the power-off state by detecting the tube temperature of the evaporator, the judgement unit 20 can judge that the compressor is under the over-load protection. Otherwise, when the detection unit 10 detects that the state of the compressor is the power-on state by detecting the tube temperature of the evaporator, the judgement unit 20 can judge that the compressor is not under the over-load protection, namely the compressor is in a normal working state.

The shielding unit 30 is configured to shield fluorine shortage protection if the compressor is under the over-load protection. When the judgement unit 20 judges that the compressor is under the over-load protection, the shielding unit 30 is configured to shield the fluorine shortage protection. Otherwise, the shielding unit 30 does not shield the fluorine shortage protection, wherein shielding the fluorine shortage protection by the shielding unit 30 may be control logic for shielding the fluorine shortage protection.

By means of the embodiment of the disclosure, when the detection unit 10 detects that the exhaust temperature of the compressor is over-high, it is determined that the compressor is in the power-off state. When the compressor is in the power-off state, the judgement unit 20 judges that the compressor is under the over-load protection, and at this time, the shielding unit 30 executes a fluorine shortage protection shielding motion. Thus, the effect of preventing a fluorine shortage false alarm when the compressor is under the over-load protection is achieved.

Figure 2:
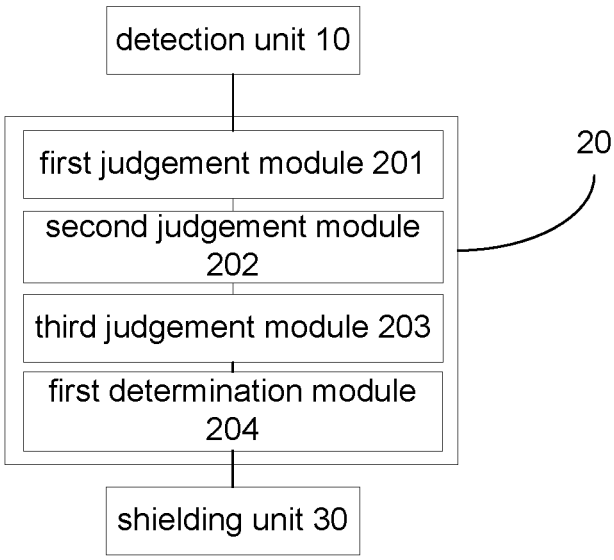
FIG. 2 is a diagram of a compressor over-load protection control apparatus according to a second embodiment of the disclosure.

FIG. 2 is a diagram of a compressor over-load protection control apparatus according to a second embodiment of the disclosure. The embodiment can be taken as a preferred implementation mode of the embodiment shown in FIG. 1. The compressor over-load protection control apparatus in the embodiment includes a detection unit 10, a judgement unit 20 and a shielding unit 30 in the first embodiment, wherein the judgement unit 20 includes: a first judgement module 201, a second judgement module 202, a third judgement module 203 and a first determination module 204.

The shielding unit 30 here is identical to that in the first embodiment in function, and is no longer described in detail herein.

The detection unit 10 is further configured to detect a tube temperature of the evaporator within a first target time period and an environment temperature and a tube temperature of the evaporator within a second target time period, the first target time period and the second target time period being adjacent time periods, and the second target time period being behind the first target time period.

In the embodiment of the disclosure, the detection unit 10 may include a first detection module, a second detection module and a third detection module. Specifically, the first detection module is configured to detect a first tube temperature of the evaporator at a first moment; the second detection module is configured to detect a second tube temperature of the evaporator at a second moment; and the third detection module is configured to detect a third tube temperature of the evaporator at a third moment, wherein the first moment, the second moment and the third moment may be any three successive time points within the first target time period, and the first moment, the second moment and the third moment are arranged on a time axis according to a time sequence.

The detection unit 10 may further include a fourth detection module and a fifth detection module. Specifically, the fourth detection module is configured to detect a fourth tube temperature of the evaporator at a fourth moment; and the fifth detection module is configured to detect a fifth tube temperature of the evaporator at a fifth moment, wherein the fourth moment and the fifth moment are any successive time points within the second target time period, and the fifth moment is behind the fourth moment.

The first judgement module 201 is configured to judge whether the tube temperature of the evaporator within the first target time period continuously rises and reaches a maximum value. A time length of the first target time period can be pre-set. Preferably, the time length of the first target time period can be pre-set as 3 min. Within the first target time period, when the first tube temperature, the second tube temperature and the third tube temperature rise sequentially and the three tube temperatures are successive values, the first judgement module 201 judges that the tube temperature of the evaporator within the first target time period continuously rises. Furthermore, under a critical state, when the first tube temperature and the third tube temperature are smaller than the second tube temperature, the first judgement module 201 judges that the tube temperature within the first target time period continuously rises and reaches the maximum value under the critical state. It is important to note that the second tube temperature corresponding to the second moment is a maximum temperature within the first target time period under the critical state.

The second judgement module 202 is configured to judge whether a temperature difference obtained by continuous rise of the tube temperature within the first target time period is greater than or equal to a pre-set temperature difference after the first judgement module 201 judges that the tube temperature of the evaporator within the first target time period continuously rises and reaches the maximum value. For example, the pre-set temperature difference may be 15 DEG C.

In the embodiment of the disclosure, the second judgement module 202 may include a calculation sub-module and a judgement sub-module. When the fourth detection module detects the fourth tube temperature and the fifth detection module detects the fifth tube temperature, the calculation sub-module is configured to calculate a temperature difference between the fifth tube temperature and the fourth tube temperature; and within the second target time period, when the fourth tube temperature is greater than the fifth tube temperature, namely when the temperature difference is less than 0 and the two tube temperatures are successive values, the judgement sub-module judges that the tube temperature of the evaporator within the second target time period continuously drops.

The third judgement module 203 is configured to judge whether a difference between the environment temperature and the tube temperature of the evaporator within the second target time period is smaller than a pre-set temperature difference limiting value after the second judgement module 202 judges that the temperature difference obtained by continuous rise of the tube temperature of the evaporator within the first target time period is greater than or equal to the pre-set temperature difference. For example, the pre-set temperature difference limiting value may be 5 DEG C.

In the embodiment of the disclosure, the first determination module 204 is configured to determine that the compressor is under the over-load protection after the third judgement module 203 judges that the difference between the environment temperature and the tube temperature of the evaporator within the second target time period is smaller than the pre-set temperature difference limiting value. Namely, the judgement unit 20 is configured to judge that the compressor is in the power-off state at this time.

In the embodiment of the disclosure, the shielding unit 30 may include a first obtaining module, a second determination module and a shielding module. The first obtaining module is configured to obtain a pre-set over-load protection time period. For example, the pre-set over-load protection time period may be set as 60 min. After the obtaining module obtains the pre-set over-load protection time period, the second determination module is configured to remove the first target time period and the second target time period from the pre-set over-load protection time period to determine a third target time period, wherein the first target time period, the second target time period and the third target time period are successive time periods, and the third target time period is behind the second target time period. After the third target time period is obtained, the shielding module is configured to shield the fluorine shortage protection within the third target time period. Furthermore, the shielding module is further configured to shield the fluorine shortage protection within a time period extending backwards from the third target time period. For example, suppose the pre-set over-load protection time period is 60 min and time lengths of the first target time period and the second target time period are 3 min and 5 min, the third target time period is the last 52 min of a certain hour. Thus, the shielding module can be configured to shield the fluorine shortage protection within the last 52 min of the certain hour or shield the fluorine shortage protection between the last 52 min of the certain hour and the first 10 min of a next hour.

In the embodiment of the disclosure, the shielding unit 30 may include a second obtaining module, a sixth detection module and a shielding unit. The second obtaining module is configured to obtain a fluorine shortage protection stop command sent to the compressor, wherein the fluorine shortage protection stop command includes a first fluorine shortage protection stop command, a second fluorine shortage protection stop command and a third fluorine shortage protection stop command. Specifically, when fluorine shortage protection data is detected for the first time, the main controller sends the first fluorine shortage protection stop command to the compressor; when the fluorine shortage protection data is detected for the second time, the main controller sends the second fluorine shortage protection stop command to the compressor; and when the fluorine shortage protection data is detected for the third time, the main controller sends the third fluorine shortage protection stop command to the compressor. The sixth detection module is configured to detect whether a moment at which the third fluorine shortage protection stop command is sent is within the first target time period or the second target time period. The shielding unit is configured to shield the fluorine shortage protection when the sixth detection module detects that the moment at which the third fluorine shortage protection stop command is sent is within the first target time period or the second target time period, and otherwise, the shielding unit will not shield the fluorine shortage protection. When the sixth detection module detects that the moment at which the third fluorine shortage protection stop command is sent is within the first target time period or the second target time period, the shielding unit does not shield the fluorine shortage protection. At this time, it is determined that the fluorine shortage protection is normal fluorine shortage protection, and a fluorine shortage protection alarm is given.

Figure 3:
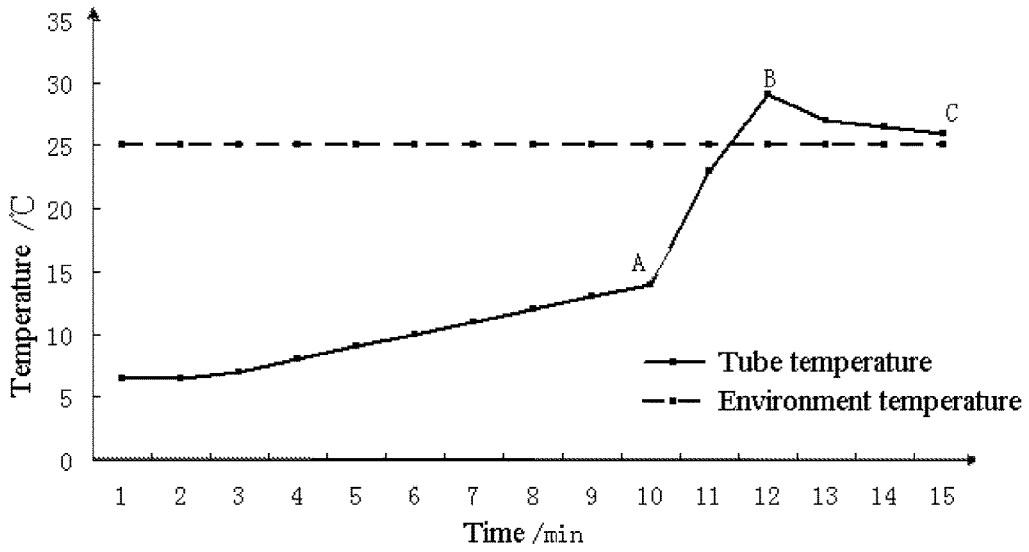
FIG. 3 is a diagram of a curve regarding an environment temperature and a tube temperature of an evaporator during compressor over-load protection according to a second embodiment of the disclosure.

For example, as shown in FIG. 3, a horizontal axis represents a time axis (unit: min), a longitudinal axis represents a temperature axis (unit: DEG C), a dotted line represents the environment temperature, and a broken line represents the tube temperature of the evaporator. Suppose the environment temperature is 25 DEG C, a relative environment humidity is 80%, a maximum time length of the first target time period is 3 min, a maximum time length of the second target time period is 5 min, the pre-set temperature difference is 15 DEG C, and the pre-set temperature difference limiting value is 5 DEG C. In the embodiment, the tube temperature of the evaporator within about 3 min to 10.5 min in front of a point A probably rises from 7 DEG C to 14 DEG C, and the rising speed of the tube temperature is relatively low. The tube temperature of the evaporator, detected by the detection unit 10, within about 10.5 min to 12.5 min between the point A and a point B probably continues to rise from 14 DEG C to 29 DEG C. The tube temperature of the evaporator, detected by the detection unit 10, at the point B reaches a maximum value namely 29 DEG C. A time length of a time period between the point A and the point B is about 2 min, namely the time period between the point A and the point B may be the first target time period. After the tube temperature of the evaporator, detected by the detection unit 10, probably continues to rise from 14 DEG C to 29 DEG C, the first judgement module 201 judges that the tube temperature of the evaporator continuously rises and reaches the maximum value namely 29 DEG C. The second judgement module 202 judges that a temperature difference obtained by continuous rise of the tube temperature of the evaporator within the time period between the point A and the point B is 15 DEG C, and the temperature difference namely 15 DEG C is equal to the pre-set temperature difference namely 15 DEG C. Within about 12.5 min to 14.5 min between the point B and a point C, the tube temperature of the evaporator, detected by the detection unit 10, probably ranges from 26 DEG C to 29 DEG C, and the detection unit 10 detects that the environment temperature is 25 DEG C at the same time. Thus, within about 12.5 min to 14.5 min between the point B and the point C, a maximum value of the difference between the environment temperature and the tube temperature of the evaporator is 4 DEG C, and a minimum value is 1 DEG C. Consequently, the third judgement module 203 judges that the maximum value of the difference between the environment temperature and the tube temperature of the evaporator is 4 DEG C, which is smaller than the pre-set temperature difference limiting value namely 5 DEG C. By means of a detection result, the first determination module 204 of the judgement unit 20 determines that the compressor is in an over-load protection state namely the compressor has stopped due to over-load protection. After the first determination module 204 of the judgement unit 20 determines that the compressor is in the over-load protection state namely the compressor has stopped due to the over-load protection, the shielding unit 30 shields the fluorine shortage protection from the moment namely 14.5 min corresponding to the point C. Suppose a pre-set over-load protection time length of the compressor is 60 min, shielding of the fluorine shortage protection can be continued from 14.5 min to 60 min or 70 min. The shielding of the fluorine shortage protection is released 60 min or 70 min later.

Thus, by means of the embodiments of the disclosure, after it is judged that the tube temperature of the evaporator within the first target time period continuously rises and reaches the maximum value, it is judged that the temperature difference obtained by continuous rise of the tube temperature of the evaporator within the first target time period is greater than or equal to the pre-set temperature difference and it is judged that the difference between the environment temperature and the tube temperature of the evaporator within the second target time period is smaller than the pre-set temperature difference limiting value, the fluorine shortage protection is shielded in time, and a fluorine shortage false alarm is eliminated, thereby achieving the effect of preventing the fluorine shortage false alarm when the compressor is under the over-load protection.

According to the embodiments of the disclosure, a compressor over-load protection control method is provided, which is configured to shield fluorine shortage protection when a compressor is under over-load protection. It is important to note that the compressor over-load protection control method provided by the embodiments of the disclosure can be executed on a computer device. It is important to note that the compressor over-load protection control method provided by the embodiments of the disclosure can be executed by means of the compressor over-load protection control apparatus according to the embodiments of the disclosure. The compressor over-load protection control apparatus according to the embodiments of the disclosure can also be configured to execute the compressor over-load protection control method according to the embodiments of the disclosure.

Figure 4:
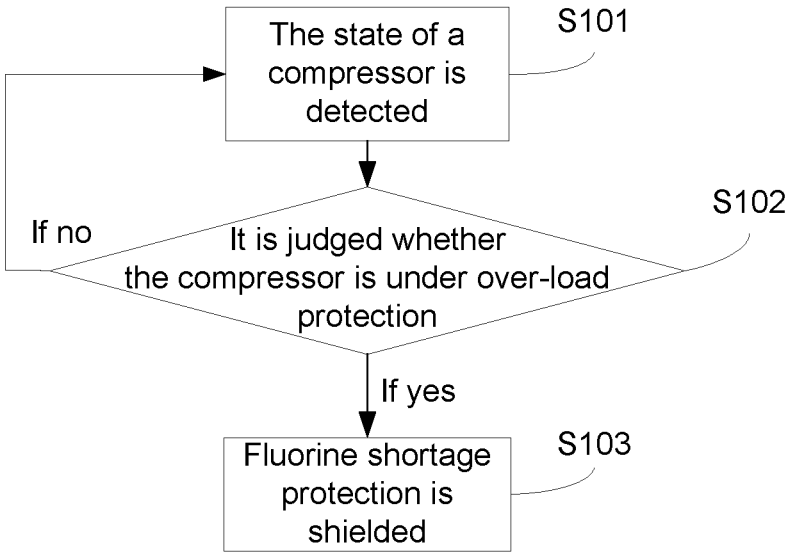
FIG. 4 is a flowchart of a compressor over-load protection control method according to a first embodiment of the disclosure.

FIG. 4 is a flowchart of a compressor over-load protection control method according to a first embodiment of the disclosure. As shown in FIG. 4, the compressor over-load protection control method includes Step S101 to Step S103 as follows.

Step S101: The state of a compressor is detected.

Detecting the state of the compressor may refer to detecting whether the state of the compressor is a power-on state and a power-off state. It is important to note that in the embodiment of the disclosure, when the compressor is in the power-off state, the overall compressor is still in an electrified state. When the compressor is over-loaded, an exhaust temperature of the compressor will be very high. Once the exhaust temperature of the compressor is over-high, the compressor will be powered off. At this time, detecting the state of the compressor will refer to detecting that the state of the compressor is the power-off state. Otherwise, it will be detected that the state of the compressor is the power-on state. Detecting the state of the compressor may refer to detecting whether the compressor is in the power-on state or the power-off state by detecting a tube temperature of an evaporator. It is important to note that Step S101 is executed by a main controller for a dehumidifier and an air conditioner.

Step S102: It is judged whether the compressor is under over-load protection.

When it is detected that the state of the compressor is the power-off state, it can be judged that the compressor is under the over-load protection. Otherwise, when it is detected that the state of the compressor is the power-on state, it can be judged that the compressor is not under the over-load protection, namely the compressor is in a normal working state. When it is judged that the compressor is not under the over-load protection, Step S101 is executed. When it is judged that the compressor is under the over-load protection, Step S103 is executed.

Step S103: Fluorine shortage protection is shielded.

When it is judged that the compressor is under the over-load protection, the fluorine shortage protection is shielded. Otherwise, the fluorine shortage protection is not shielded, wherein shielding the fluorine shortage protection may be control logic for shielding the fluorine shortage protection.

By means of the embodiment of the disclosure, when it is detected that the compressor is in the power-off state due to over-high exhaust temperature, it is judged that the compressor is under the over-load protection, and at this time, the fluorine shortage protection is shielded. Thus, the effect of preventing a fluorine shortage false alarm when the compressor is under the over-load protection is achieved.

Figure 5:
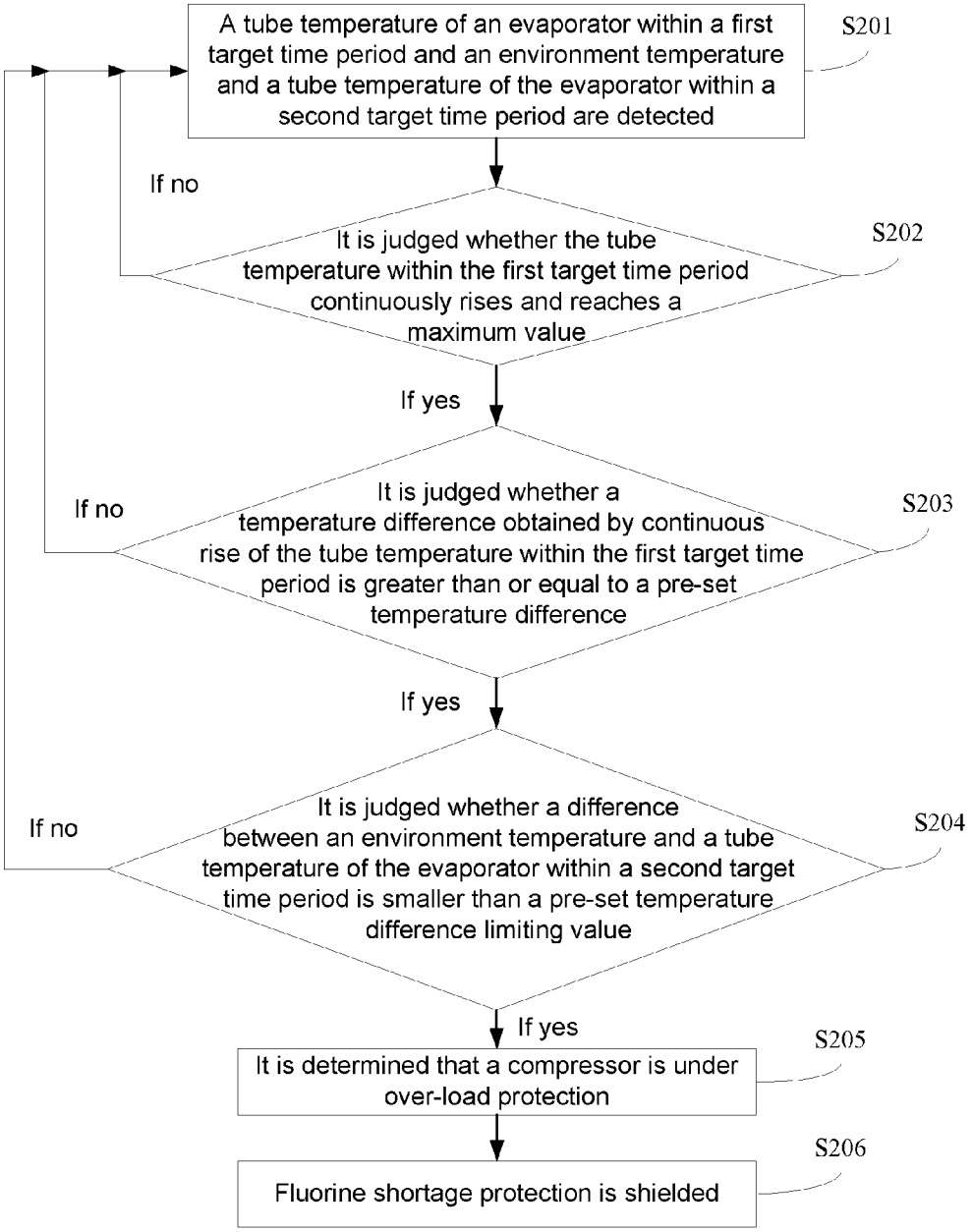
FIG. 5 is a flowchart of a compressor over-load protection control method according to a second embodiment of the disclosure.

FIG. 5 is a flowchart of a compressor over-load protection control method according to a second embodiment of the disclosure. As shown in FIG. 5, the method includes Step 201 to Step 206. The embodiment can be taken as a preferred implementation mode of the embodiment shown in FIG. 4.

Step S201: A tube temperature of an evaporator within a first target time period and an environment temperature and a tube temperature of the evaporator within a second target time period are detected.

In the embodiment of the disclosure, the first target time period and the second target time period are adjacent time periods, and the second target time period is behind the first target time period. A time length of the first target time period can be pre-set, and preferably, the time length of the first target time period can be pre-set as 3 min. In the embodiment of the disclosure, specifically, the step that the tube temperature of the evaporator within the first target time period is detected includes that: a first tube temperature of the evaporator at a first moment is detected, a second tube temperature of the evaporator at a second moment is detected, and a third tube temperature of the evaporator at a third moment is detected, wherein the first moment, the second moment and the third moment may be any three successive time points within the first target time period, and the first moment, the second moment and the third moment are arranged on a time axis according to a time sequence. In the embodiment of the disclosure, specifically, the step that the tube temperature of the evaporator within the second target time period is detected includes that: a fourth tube temperature of the evaporator at a fourth moment is detected, and a fifth tube temperature of the evaporator at a fifth moment is detected, wherein the fourth moment and the fifth moment are any successive time points within the second target time period, and the fifth moment is behind the fourth moment.

Step S202: It is judged whether the tube temperature within the first target time period continuously rises and reaches a maximum value.

It is important to note that within the first target time period, when the first tube temperature, the second tube temperature and the third tube temperature rise sequentially and the three tube temperatures are successive values, a first judgement module 201 judges that the tube temperature of the evaporator within the first target time period continuously rises. Furthermore, under a critical state, when the first tube temperature and the third tube temperature are smaller than the second tube temperature, it is judged that the tube temperature within the first target time period continuously rises and reaches the maximum value under the critical state. It is important to note that the second tube temperature corresponding to the second moment is a maximum temperature within the first target time period under the critical state. If it is judged that the tube temperature of the evaporator within the first target time period continuously rises and reaches the maximum value, Step S203 is executed, and otherwise, Step S201 is executed.

Step S203: It is judged whether a temperature difference obtained by continuous rise of the tube temperature of the evaporator within the first target time period is greater than or equal to a pre-set temperature difference.

After it is judged that the tube temperature of the evaporator within the first target time period continuously rises and reaches the maximum value, it is judged whether the temperature difference obtained by continuous rise of the tube temperature of the evaporator within the first target time period is greater than or equal to the pre-set temperature difference. For example, when the pre-set temperature difference is 15 DEG C, and when a difference between a tube temperature at an ending moment of the first target time period and a tube temperature at a starting moment of the first target time period is greater than 15 DEG C within the first target time period, it is judged that the temperature difference obtained by continuous rise of the tube temperature of the evaporator within the first target time period is greater than the pre-set temperature difference. When it is judged that the temperature difference obtained by continuous rise of the tube temperature of the evaporator within the first target time period is greater than the pre-set temperature difference, Step S204 is executed, and otherwise, Step S201 is executed.

It is important to note that Step S202 and Step S203 can be executed in a reverse sequence.

Step S204: It is judged whether a difference between the environment temperature and the tube temperature of the evaporator within the second target time period is smaller than a pre-set temperature difference limiting value.

In the embodiment of the disclosure, if it is judged that the temperature difference obtained by continuous rise of the tube temperature of the evaporator is greater than or equal to the pre-set temperature difference, it is judged whether the difference between the environment temperature and the tube temperature of the evaporator within the second target time period is smaller than the pre-set temperature difference limiting value, wherein the pre-set temperature difference limiting value may be 5 DEG C. If it is judged that the difference between the environment temperature and the tube temperature of the evaporator within the second target time period is smaller than the pre-set temperature difference limiting value, Step S205 is executed, and otherwise, Step S201 is re-executed. In the embodiment of the disclosure, when a fourth detection module detects the fourth tube temperature and a fifth detection module detects the fifth tube temperature, a temperature difference between the fifth tube temperature and the fourth tube temperature can be calculated. Within the second target time period, when the fifth tube temperature is smaller than the fourth tube temperature, namely when the temperature difference is less than 0 and the two tube temperatures are successive values, it is judged that the tube temperature of the evaporator within the second target time period continuously drops. If it is judged that the difference between the environment temperature and the tube temperature of the evaporator within the second target time period is smaller than the pre-set temperature difference limiting value, and it is judged that the tube temperature of the evaporator within the second target time period continuously drops, Step S205 is executed, and Step S201 is re-executed.

Step S205: It is determined that the compressor is under over-load protection.

If it is judged that the difference between the environment temperature and the tube temperature of the evaporator within the second target time period is smaller than the pre-set temperature difference limiting value, it is determined that the compressor is under the over-load protection. Otherwise, it is judged that the compressor is not under the over-load protection. If it is determined that the compressor is under the over-load protection, Step S206 is executed.

Step S206: If the compressor is under the over-load protection, fluorine shortage protection is shielded.

In the embodiment of the disclosure, the fluorine shortage protection can be shielded by adopting the steps as follows.

A pre-set over-load protection time period is obtained. For example, the pre-set over-load protection time period can be set as 60 min. After the pre-set over-load protection time period is obtained, the first target time period and the second target time period are removed from the pre-set over-load protection time period to determine a third target time period, wherein the first target time period, the second target time period and the third target time period are successive time periods, and the third target time period is behind the second target time period. After the third target time period is obtained, the fluorine shortage protection is shielded within the third target time period, or the fluorine shortage protection is shielded within a certain time period extending from the third target time period. For example, suppose the pre-set over-load protection time period is set as 60 min and time lengths of the first target time period and the second target time period are 3 min and 5 min, the third target time period is the last 52 min of a certain hour. Thus, the fluorine shortage protection can be shielded within the last 52 min of the certain hour or the fluorine shortage protection can be shielded between the last 52 min of the certain hour and the first 10 min of a next hour.

Furthermore, in the embodiment of the disclosure, before the fluorine shortage protection is shielded within the third target time period, a fluorine shortage protection stop command sent to the compressor is obtained, wherein the fluorine shortage protection stop command includes a first fluorine shortage protection stop command, a second fluorine shortage protection stop command and a third fluorine shortage protection stop command. Specifically, when fluorine shortage protection data is detected for the first time, the main controller sends the first fluorine shortage protection stop command to the compressor; when the fluorine shortage protection data is detected for the second time, the main controller sends the second fluorine shortage protection stop command to the compressor; and when the fluorine shortage protection data is detected for the third time, the main controller sends the third fluorine shortage protection stop command to the compressor. It is detected whether a moment at which the third fluorine shortage protection stop command is sent is within the first target time period or the second target time period. When it is detected that the moment at which the third fluorine shortage protection stop command is sent is within the first target time period or the second target time period, the fluorine shortage protection is detected, and otherwise, the fluorine shortage protection is not shielded. When it is detected that the moment at which the third fluorine shortage protection stop command is sent is within the first target time period or the second target time period, the fluorine shortage protection is not shielded. At this time, it is determined that the fluorine shortage protection is normal fluorine shortage protection, and a fluorine shortage protection alarm is given.

From the above descriptions, it can be seen that by means of the disclosure, after it is judged that the tube temperature of the evaporator within the first target time period continuously rises and reaches the maximum value, it is judged that the temperature difference obtained by continuous rise of the tube temperature of the evaporator within the first target time period is greater than or equal to the pre-set temperature difference and it is judged that the difference between the environment temperature and the tube temperature of the evaporator within the second target time period is smaller than the pre-set temperature difference limiting value, the fluorine shortage protection is shielded, and a fluorine shortage false alarm is eliminated, thereby achieving the effect of preventing the fluorine shortage false alarm when the compressor is under the over-load protection.

It is important to note that the steps shown in the flowcharts of the drawings can be executed in a computer system including a set of computer executable instructions. Moreover, although a logic sequence is shown in the flowcharts, the shown or described steps can be executed in a sequence different from the sequence here under certain conditions.

Obviously, those skilled in the art should understand that all modules or all steps in the disclosure can be realized by using a general calculation apparatus, can be centralized on a single calculation apparatus or can be distributed on a network composed of a plurality of calculation apparatuses. Optionally, they can be realized by using executable program codes of the calculation apparatuses. Thus, they can be stored in a storage apparatus and executed by the calculation apparatuses, or they are manufactured into each integrated circuit module respectively, or a plurality of modules or steps therein are manufactured into a single integrated circuit module. Thus, the disclosure is not limited to a combination of any specific hardware and software.

The above is only the preferred embodiments of the disclosure, and is not intended to limit the invention. There can be various modifications and variations in the disclosure for those skilled in the art. Any modifications, equivalent replacements, improvements and the like within the spirit and principle of the disclosure shall fall within the protection scope of the invention.

What is claimed is:

1. A compressor over-load protection control method, comprising:

detecting a state of a compressor;

judging whether the compressor is under over-load protection; and shielding fluorine shortage protection when the compressor is under the over-load protection.

2. The compressor over-load protection control method according to claim 1, wherein the compressor over-load protection control method is configured for over-load protection of a dehumidifier comprising an evaporator and the compressor;

detecting the state of the compressor comprises: detecting a tube temperature of the evaporator within a first target time period and an environment temperature and a tube temperature of the evaporator within a second target time period, the first target time period and the second target time period being adjacent time periods, and the second target time period being after the first target time period; and judging whether the compressor is under the over-load protection comprises: judging whether the tube temperature within the first target time period continuously rises and reaches a maximum value; after it is judged that the tube temperature within the first target time period continuously rises and reaches the maximum value, judging whether a temperature difference obtained by continuous rise of the tube temperature within the first target time period is greater than or equal to a pre-set temperature difference; after it is judged that the temperature difference obtained by continuous rise of the tube temperature within the first target time period is greater than or equal to the pre-set temperature difference, judging whether a difference between the environment temperature and the tube temperature within the second target time period is smaller than a pre-set temperature difference limiting value; and when it is judged that the difference between the environment temperature and the tube temperature within the second target time period is smaller than the pre-set temperature difference limiting value, determining that the compressor is under the over-load protection.

3. The compressor over-load protection control method according to claim 2, wherein detecting the tube temperature of the evaporator within the first target time period comprises: detecting a first tube temperature of the evaporator at a first moment, detecting a second tube temperature of the evaporator at a second moment, and detecting a third tube temperature of the evaporator at a third moment, the first moment, the second moment and the third moment being any successive time points within the first target time period, the second moment being after the first moment, and the third moment being after the second moment; and judging whether the tube temperature within the first target time period continuously rises and reaches the maximum value comprises: judging whether the tube temperature of the evaporator within the first target time period continuously rises and reaches the maximum value by comparing difference among the first tube temperature, the second tube temperature and the third tube temperature.

4. The compressor over-load protection control method according to claim 2, wherein detecting the tube temperature of the evaporator within the second target time period comprises: detecting a fourth tube temperature of the evaporator at a fourth moment, and detecting a fifth tube temperature of the evaporator at a fifth moment, the fourth moment and the fifth moment being any successive time points within the second target time period, and the fifth moment being after the fourth moment; and judging whether the difference between the environment temperature and the tube temperature within the second target time period is smaller than the pre-set temperature difference limiting value comprises: calculating a temperature difference between the fifth tube temperature and the fourth tube temperature; and judging whether the tube temperature continuously drops within the second target time period by judging whether the temperature difference is less than 0.

5. The compressor over-load protection control method according to claim 2, wherein shielding the fluorine shortage protection comprises:

obtaining a pre-set over-load protection time period;

removing the first target time period and the second target time period from the pre-set over-load protection time period to determine a third target time period, the third target time period being adjacent to the second target time period, and the third target time period being after the second target time period; and shielding the fluorine shortage protection within the third target time period.

6. The compressor over-load protection control method according to claim 5, wherein before the fluorine shortage protection is shielded within the third target time period, shielding the fluorine shortage protection further comprises:

obtaining a fluorine shortage protection stop command sent to the compressor, the fluorine shortage protection stop command including a first fluorine shortage protection stop command, a second fluorine shortage protection stop command and a third fluorine shortage protection stop command; and detecting whether a moment at which the third fluorine shortage protection stop command is sent is within the first target time period or the second target time period, when it is detected that the moment at which the third fluorine shortage protection stop command is sent is not within the first target time period or the second target time period, the fluorine shortage protection being shielded.

7. A compressor over-load protection control apparatus, comprising:

a detection unit, configured to detect a state of a compressor;

a judgement unit, configured to judge whether the compressor is under over-load protection; and a shielding unit, configured to shield fluorine shortage protection when the compressor is under over-load protection.

8. The compressor over-load protection control apparatus according to claim 7, wherein the compressor over-load protection control apparatus is configured for over-load protection of a dehumidifier comprising an evaporator and the compressor;

the detection unit is further configured to detect a tube temperature of the evaporator within a first target time period and an environment temperature and a tube temperature of the evaporator within a second target time period, the first target time period and the second target time period being adjacent time periods, and the second target time period being after the first target time period; and the judgement unit comprises: a first judgement module, configured to judge whether the tube temperature within the first target time period continuously rises and reaches a maximum value; a second judgement module, configured to judge whether a temperature difference obtained by continuous rise of the tube temperature within the first target time period is greater than or equal to a pre-set temperature difference after it is judged that the tube temperature within the first target time period continuously rises and reaches the maximum value; a third judgement module, configured to judge whether a difference between the environment temperature and the tube temperature within the second target time period is smaller than a pre-set temperature difference limiting value after it is judged that the temperature difference obtained by continuous rise of the tube temperature within the first target time period is greater than or equal to the pre-set temperature difference; and a first determination module, configured to determine that the compressor is under the over-load protection when it is judged that the difference between the environment temperature and the tube temperature within the second target time period is smaller than the pre-set temperature difference limiting value.

9. The compressor over-load protection control apparatus according to claim 8, wherein the detection unit comprises:

a first detection module, configured to detect a first tube temperature of the evaporator at a first moment;

a second detection module, configured to detect a second tube temperature of the evaporator at a second moment; and a third detection module, configured to detect a third tube temperature of the evaporator at a third moment, the first moment, the second moment and the third moment being any successive time points within the first target time period, the second moment being after the first moment, the third moment being after the second moment, and the first judgement module being further configured to judge whether the tube temperature of the evaporator within the first target time period continuously rises and reaches the maximum value by comparing difference among the first tube temperature, the second tube temperature and the third tube temperature.

10. The compressor over-load protection control apparatus according to claim 8, wherein the detection unit further comprises: a fourth detection module, configured to detect a fourth tube temperature of the evaporator at a fourth moment; and a fifth detection module, configured to detect a fifth tube temperature of the evaporator at a fifth moment, the fourth moment and the fifth moment being any successive time points within the second target time period, and the fifth moment being after the fourth moment; and the second judgement module comprises: a calculation sub-module, configured to calculate a temperature difference between the fifth tube temperature and the fourth tube temperature; and a judgement sub-module, configured to judge whether the tube temperature continuously drops within the second target time period by judging whether the temperature difference is less than 0.

11. The compressor over-load protection control apparatus according to claim 8, wherein the shielding unit comprises:

a first obtaining module, configured to obtain a pre-set over-load protection time period;

a second determination module, configured to remove the first target time period and the second target time period from the pre-set over-load protection time period to determine a third target time period, the third target time period being adjacent to the second target time period, and the third target time period being after the second target time period; and a shielding module, configured to shield the fluorine shortage protection within the third target time period.

12. The compressor over-load protection control apparatus according to claim 11, wherein the shielding unit further comprises:

a second obtaining module, configured to obtain a fluorine shortage protection stop command sent to the compressor before the fluorine shortage protection is shielded within the third target time period, the fluorine shortage protection stop command including a first fluorine shortage protection stop command, a second fluorine shortage protection stop command and a third fluorine shortage protection stop command; and a sixth detection module, configured to detect whether a moment at which the third fluorine shortage protection stop command is sent is within the first target time period or the second target time period, the shielding unit being further configured to shield the fluorine shortage protection when it is detected that the moment at which the third fluorine shortage protection stop command is sent is not within the first target time period or the second target time period.

* * * * *